US010265702B2

(12) United States Patent
Li et al.

(10) Patent No.: US 10,265,702 B2
(45) Date of Patent: Apr. 23, 2019

(54) DRY METHOD HEAVY MEDIUM SEPARATOR ADOPTING DRY METHOD HEAVY MEDIUM SEPARATION BED AND SEPARATION DEVICE

(71) Applicant: Tangshan Shenzhou Manufacturing Co., Ltd., Hebei (CN)

(72) Inventors: Gongmin Li, Hebei (CN); Jing Li, Hebei (CN); Zhifu Cui, Hebei (CN)

(73) Assignee: Tangshan Shenzhou Manufacturing Co., Ltd., Hebei (CN)

( * ) Notice: Subject to any disclaimer, the term of this patent is extended or adjusted under 35 U.S.C. 154(b) by 42 days.

(21) Appl. No.: 15/389,228

(22) Filed: Dec. 22, 2016

(65) Prior Publication Data

US 2017/0100722 A1 Apr. 13, 2017

Related U.S. Application Data

(63) Continuation of application No. PCT/CN2015/076990, filed on Apr. 20, 2015.

(30) Foreign Application Priority Data

Dec. 30, 2014 (CN) ..... 2014 1 0840479

(51) Int. Cl.
*B03B 5/46* (2006.01)
*B07B 15/00* (2006.01)
(Continued)

(52) U.S. Cl.
CPC ..... *B03B 5/46* (2013.01); *B03B 4/00* (2013.01); *B03B 7/00* (2013.01); *B07B 15/00* (2013.01)

(58) Field of Classification Search
CPC .... B07B 1/18; B07B 1/22; B07B 4/06; B07B 15/00; B03B 5/46; B03B 4/00; B03B 7/00
(Continued)

(56) References Cited

U.S. PATENT DOCUMENTS 3,794,162 A * 2/1974 Miller ..... B03B 5/28 209/172.5
4,511,461 A * 4/1985 Kruyer ..... B03B 1/04 209/166
(Continued)

*Primary Examiner* — Joseph C Rodriguez
*Assistant Examiner* — Kalyanavenkateshware Kumar
(74) *Attorney, Agent, or Firm* — Levine Bagade Han LLP

(57) ABSTRACT

The present invention provides a dry method heavy medium separator adopting a dry method heavy medium separation bed and a separation device. According to the dry method heavy medium separator, a floating material end medium drum screen and a sediment end medium drum screen are arranged below a floating material discharge end and a sediment discharge end of the dry method heavy medium separator and used for separating products from media; a bag-type dust collector is used for collecting dust, a dust collector pipeline is arranged at the top of the dry method heavy medium separator, the air draft volume is larger than the air supply volume during working of the dry method heavy medium separator, the inside of the separator is in a negative pressure state, and therefore dust in the dry method heavy medium separator cannot escape; and the whole system is in a fully closed working state. According to the dry method heavy medium separator adopting the dry method heavy medium separation bed and the separation device, the problems that the fluidization density is instable, the air flow distribution is not uniform in a fluidization process, the medium separation efficiency of an existing medium separation screen for fine materials is low, the magnetic medium content of the fine materials subjected to
(Continued)

medium separation is high, and the like are solved, and the medium separation efficiency for fine materials can be improved remarkably.

6 Claims, 6 Drawing Sheets

(51) Int. Cl.
*B03B 7/00* (2006.01)
*B03B 4/00* (2006.01)

(58) Field of Classification Search
USPC ..... 209/38, 471, 472, 486, 492, 502, 504
See application file for complete search history.

(56) References Cited

U.S. PATENT DOCUMENTS 5,197,398 A * 3/1993 Levy ..... B03B 5/30
110/218
6,722,503 B2 * 4/2004 Watters ..... B03B 9/00
209/215
7,708,145 B2 * 5/2010 Li ..... B03B 4/02
209/471

* cited by examiner

DRY METHOD HEAVY MEDIUM SEPARATOR ADOPTING DRY METHOD HEAVY MEDIUM SEPARATION BED AND SEPARATION DEVICE

CROSS-REFERENCE TO RELATED APPLICATIONS

This application is a continuation of International Application No. PCT/CN2015/076990, filed Apr. 20, 2015, which claims the benefit of Chinese Patent Application No. 201410840479.X, filed Dec. 30, 2014, both of which are herein incorporated by reference in their entireties.

BACKGROUND

1) Technical Field

The present invention belongs to the field of dry separation and in particular relates to a dry method heavy medium separator adopting a dry method heavy medium separation bed and a dry method heavy medium separation device, especially applicable to separation of coal from other ores with different densities and belonging to solid separation equipment.

2) Background of the Art

At present, dry method heavy medium separators used in industrial production at home and abroad are mainly air jig and air table which replace water with air as a separation medium. With poor separation effect, low production capacity, and high wind power requirement, they have been eliminated gradually.

Since the 1960's, scholars such as Douglas E in America and Beeckmans J M in Canada had been doing researches on dry separation based on a general gas-solid fluidized bed successively and its separation principle is that with a fine particle material (such as magnetite powder) as a dense medium, a gas-solid two-phase fluidized bed with certain density is formed under the action of a uniform upflow, separation materials (such as coal) are layered according to the density of the fluidized bed after being fed into a bed. However, these scholars, by just basing on a material replacement principle of a fluidized bed in the chemical industry, did not deeply research concentrated phase high density fluidization characteristics (such as an air distributor and grain size distribution of a dense medium) suitable for coal separation, and thus the industrialization of their researches was not achieved.

China University of Mining and Technology has been engaged in the research on fluidized dry coal preparation since the 1980's and developed gas-solid tow-phase flow based dry separation technology and equipment. Fluidizing gas and a dense medium (such as magnetite powder) with a certain particle size form a concentrated phase fluidized bed; under the uplift action of global density of the fluidized bed in a gas-solid tow-phase flow bed, separation materials are layered according to the bed density; material with density lower than the bed floats up while material with density higher than the bed density goes down, therefore the effective separation of the separation materials can be realized. The gas-solid heavy medium fluidized bed provides a new efficient clean dry separation way for coal in the world, with a wide application prospect and a significant application value. Based on its studies on the theory and process of dry method heavy medium separation since 2006, after analyzing a great deal of research data of dry method heavy medium separation, Tangshan Shenzhou Machinery Co., Ltd. has successfully researched and developed a new generation of dry method heavy medium device and put it into industrialization successfully.

However, the past studies on a dry-method heavy medium separator have the following problems: it is difficult to improve the separation accuracy and efficiency of difficult separation coal since fluidization density is instable and air flow distribution is not uniform in a fluidization process; moreover, due to such problems as the medium separating efficiency of an existing medium separating screen for fine materials is low and the magnetic medium content of the fine materials subjected to medium separation is high, the medium separating efficiency for fine materials cannot be improved.

SUMMARY

(I) Object of the Invention

In order to solve problems in the prior, the present invention provides a dry method heavy medium separator adopting a dry method heavy medium separation bed and a dry method heavy medium separation device, by which the problems that the fluidization density is instable, air flow distribution is not uniform in a fluidization process, the medium separating efficiency of an existing medium separating screen for fine materials is low, and the magnetic medium content of the fine materials subjected to medium separation is high and the like are solved and the medium separating efficiency for fine materials can be improved remarkably.

(II) Technical Solution of the Invention

The technical solution of the present invention is described as below:

According to the first aspect of the present invention, a dry method heavy medium separator adopting a dry method heavy medium separation bed is provided. The dry method heavy medium separator includes a compressed air receiver, a floating material end medium drum screen, a dust collector pipeline, a material inlet, a main heavy medium separation machine, a magnetic separator, a bag-type dust collector, a medium bucket elevator, a Roots blower, a bag-type dust collector induced draft fan, a sediment discharge end medium drum screen and high-pressure air pipes, where the floating material end medium drum screen and the sediment end medium drum screen are arranged below the floating material discharge end and the sediment discharge end of the dry method heavy medium separator and used for separating separation products from media; the bag-type dust collector is used for collecting dust, the dust collector pipeline is arranged at the top of the dry method heavy medium separator, the air draft volume is larger than the air supply volume during working of the dry method heavy medium separator so that the inside of the separator is in a negative pressure state, and therefore dust in the dry method heavy medium separator cannot escape; and suction pipes are arranged at the floating material end medium drum screen, the sediment end medium drum screen and the magnetic separator, and the whole system is in a fully closed working state.

Wherein, an air supply system of the dry method heavy medium separator consists of the compressed air receiver, the Roots blower and the high-pressure air pipes and provides a stable source for the dry method heavy medium separator in work.

Besides, three flowing material flows (air, a dense medium and coal) used in a dry method heavy medium separation bed meet in the separation bed; the dense media are in a fluidization separation chamber; and compressed air enters air chambers for primary pressure equalizing and then enters the fluidization separation chamber to fluidize the dense media so as to form a fluidized bed suitable for separation.

Further, a double-chain scraper conveyor rotates counter-clockwise respectively at different speeds; separation coal enters from one end at the upper part of a bed body; the fed materials are pushed by an upper chain to move leftwards and are layered during the movement, sediment will not be pushed by a scraper any more and will gradually go down to the bottom of the fluidization separation chamber, and a lower chain discharges the sediment from a tailing end; a floating material above the fluidized bed is discharged by the upper chain from a clean coal end; the upper space inside the main separation machine is in a negative pressure state; after media separation with drum screens, oversize products can be conveyed to a specified position by a conveying device; the undersize dense media fall down to a lower media bed and then are loaded to the bucket elevator and returns to the main separation machine via a chute; and the function of drum screen medium separating devices is that clean coal and gangue obtained after separation by the separation bed are respectively discharged from a clean coal outlet and a gangue outlet and then enter respective drum screen medium separating devices for separating media, and the drum screens drive screen surfaces to rotate through the rotation of central shafts, so that the materials are subjected to medium separation on the rotating screen surfaces. Preferably, a floating material end discharge device and a sediment end discharge device are arranged on two sides of the main separation machine and used for discharging the products and locking air.

According to the second aspect of the present invention, a method using the dry method heavy medium separator is provided and mainly includes the following steps:

Step 1, 6-100 mm-grade coal is fed into the dry method heavy medium separator and dense media are added into the dry method heavy medium separator too, where the fed materials of the dry method heavy medium separator are fed in uniformly along the width of the dry method heavy medium separator and the feeding amount and the addition of the dense media should be continuously adjustable;

Step 2, an airy supply system consists of a Roots blower, a compressed air receiver and a plurality of air pipes, the upper part of the dry method heavy medium separator is connected with an air draft dust collection system, and when the dry method heavy medium separator works, compressed air is provided for the inside of the dry method heavy medium separator by the air supply system and forms a gas-solid two-phase fluidized bed together with the dense media in a certain ratio, so as to further realize layering separation based on different densities;

Step 3, because the products discharged by the dry method heavy medium separator carry a certain amount of media, medium drum screens are arranged and placed below the floating material discharge end and sediment discharge end of the dry method heavy medium separator and used for separating the separation products from media; the separated media are elevated up into a magnetic separator at the upper part of the dry method heavy medium separator by a medium bucket elevator, pulverized coal in the media is removed by the magnetic separator and then the pure media are unloaded inside the dry method heavy medium separator so that the media can be recycled so as to reduce medium consumption; and Step 4, a dust collection pipeline is arranged at the top of the dry method heavy medium separator and is connected with a bag-type dust collector, thereby reducing the environment pollution during the working of the dry method heavy medium separator.

According to the third aspect of the present invention, a separation device adopting a dry method heavy medium separation bed, where the separation device adopts the above-mentioned dry method heavy medium separator and is a continuous-operating efficient dry method coal separation system implemented through assembling raw coal preparation, separation, medium purification and recycling, air supply and dust collection on the same platform. The separation device works based on the following principles:

(1) Fluidization Separation Process

A fine solid dense medium forms a gas-solid two-phase flow with fluid-like characteristics under the action of an upflow after uniform air distribution; under the uplift action of global density of the fluidized bed in a gas-solid tow-phase flow bed, separation materials are layered according to the bed density; a material with density lower than the bed floats up while material with density higher than the bed density goes down; layered light and heavy products are respectively discharged through a scraper conveyor, thereby finishing the separation process. The dry method heavy medium separator adopting the dry method heavy medium separation bed works to separate the separation materials by using the above-mentioned principle so as to obtain clean coal and tailing products.

(2) Working Process of Separation System

The process flow of the system is that compressed air forms a uniformly distributed upflow through a preliminary air distribution chamber and an air distributor and acts on the dense media in the dry method heavy medium separator to form a fluidized bed with a certain density; separation raw coal, after being (dried) graded (100-6 mm), is uniformity fed in the dry method heavy medium separator through a feeder; light and heavy products layered according to the density of the fluidized bed are discharged through dischargers; the light and heavy products are respectively subjected to medium separation through medium separation screens to obtain clean coal and tailing; a part of the dense media separated by the medium separation screens enters the magnetic separator for removing nonmagnetics (pulverized coal) therein and the other part is recycled for use; and the circulating medium shunt volume, the feeding amounts of magnetic concentrate and circulating media are adjusted according to the height and density of the fluidized bed in the dry method heavy medium separator, thereby realizing the control over the height and density of the fluidized bed. Dust generated during the working of the separation system is collected and circulated by an air draft dust collector.

(3) Advantageous Effects of the Invention

Therefore, according to the present invention, the dry method heavy medium separation bed can be used for carrying out high-accuracy separation on difficult separation coal with relatively high production capacity. The fluidized separation bed using dense media and pulverized coal mixed media is capable of overcoming such defects in the prior art that the fluidization density is instable and air flow distribution is not uniform, thereby improving the separation accuracy and efficiency of difficult separation coal. Further, the dry method heavy medium separator adopting the dry method heavy medium separation bed and the separation device solve such problems that the medium separation efficiency of an existing medium separation screen for fine materials is low and the magnetic medium content of the fine materials subjected to medium separation is high, thereby improving the medium separation efficiency for fine materials. The dry method heavy medium separation bed according to the present invention can be used for effectively fluidizing and layering to-be-separated materials based on density in a gas-solid two phase fluidized bed of a high-pressure gas and heavy media.

BRIEF DESCRIPTION OF THE DRAWINGS

FIG. 1-2 is a left view of the dry method heavy medium separator according to the present invention;

FIG. 1-3 is a top view of the dry method heavy medium separator according to the present invention;

FIG. 2 is a process flow diagram of the dry method heavy medium separator according to the present invention;

FIG. 3 is a schematic diagram of the structure of a main heavy medium separation machine in the dry method heavy medium separator according to the present invention;

FIG. 4-1 is a schematic diagram of a stainless steel grate in a dry method heavy medium separation mechanism;

FIG. 4-2 is a schematic diagram of the longitudinal section of the stainless steel grate in the dry method heavy medium separation mechanism;

FIG. 4-3 is a schematic diagram of the cross section of the stainless steel grate in the dry method heavy medium separation mechanism;

FIG. 5-1 is a front view of a scraper pressing wheel cleaning mechanism;

FIG. 5-2 is a left view of a scraper pressing wheel;

FIG. 6-1 is a front view of a wearable block part of a scraper conveyor;

FIG. 6-2 is a sectional view of the wearable block part of the scraper conveyor;

FIG. 7-1 is a right view of a scraper;

FIG. 7-2 is a front view of the scraper;

FIG. 8-1 is a schematic diagram of details of as high-pressure air chamber; and FIG. 8-2 is a schematic diagram of details of another high-pressure air chamber.

DETAILED DESCRIPTION

The technical solution in the embodiments of the present invention will be expressly and completely described hereinafter with reference to the accompanying drawings in the embodiments of the present invention. Obviously, the embodiments described herein are only part of rather than all of the embodiments of the present invention. Based on the embodiments of the present invention, all other embodiments obtained by those skilled in the art without paying creative labor do not depart from the protection scope of the present invention.

Aiming at the problems existing in the prior art, the inventor, for the research and development of a new generation of dry method heavy medium separator, further carries out fundamental research and development and pilot development mainly in the following aspects:

(1) Fundamental Laboratory Research and Model Test

Based on the accumulation of research for years, fundamental laboratory research and model test on the dry method heavy medium fluidized bed are performed to create a concentrated phase high density gas-solid fluidization dry separation theory, put forward an air distribution and wide-size dense media grading principle and establish a dynamical model of separation of a wide-size multi-component material in a concentrated phase high density gas-solid fluidized bed.

(2) Research of a New Generation of a Dry Method Heavy Medium Separator Adopting Dry Method Heavy Medium Fluidized Bed Based on theoretical researches, model tests and pilot scale tests, a new generation of dry method heavy medium separator is researched. Based on a special process requirement, according to the pressure drop focused principle and the low fluidization number and high pressure drop compound air distribution concept, the design of the key parts and overall structure of the dry method heavy medium separator is optimized and innovated.

The present invention will be described in detail hereinafter with reference to accompanying drawing.

Figure 1:
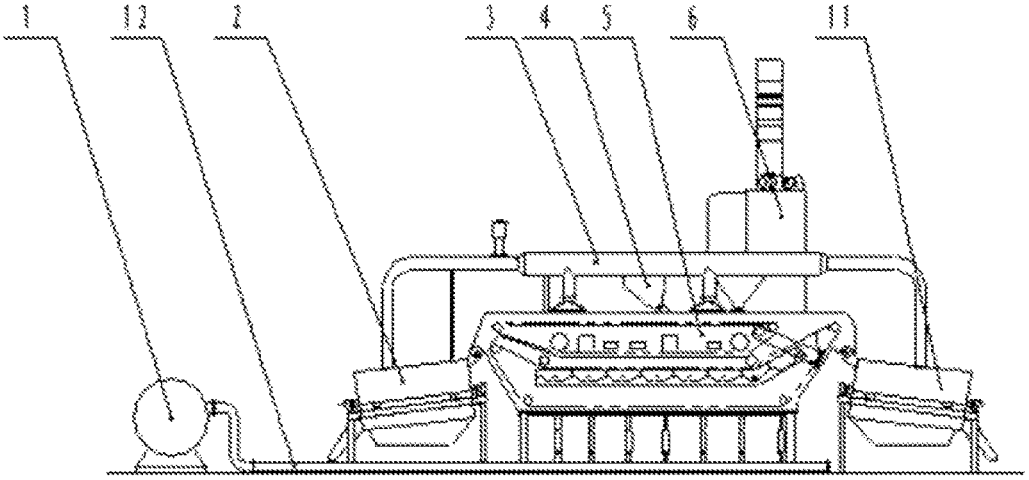
FIG. 1-1 is a front view of the dry method heavy medium separator according to the present invention.
Figures 1, 2:
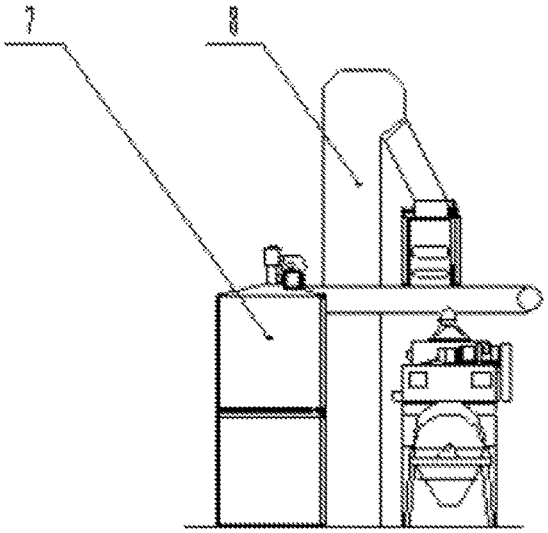
Figures 1, 2, 3:
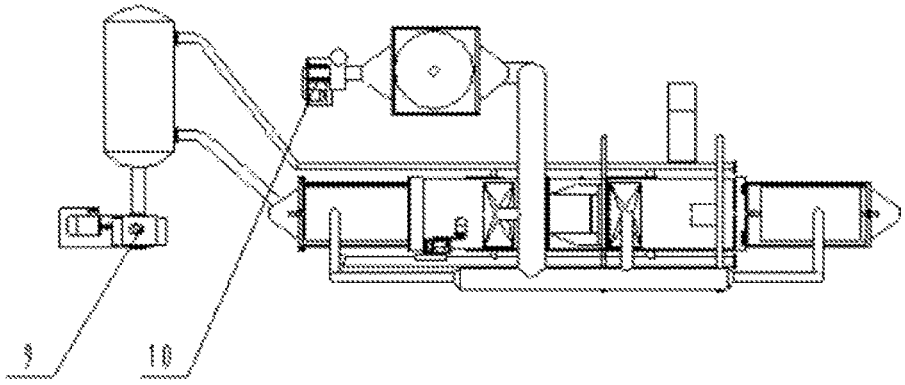
Figure 2:
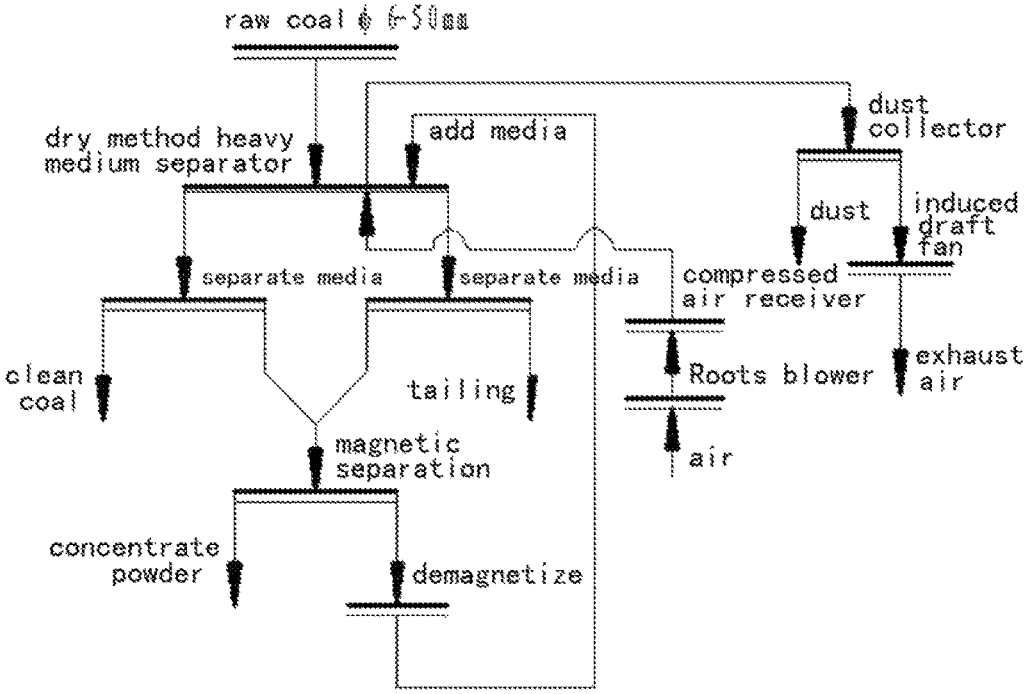
Figure 3:
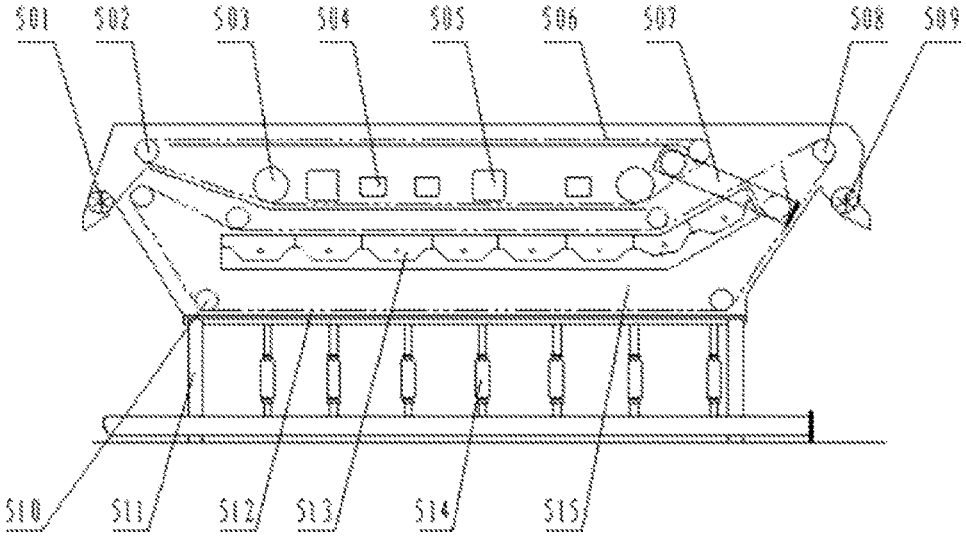

FIGS. 1-1 to 1-3 are a front view, a left view and a top view of the dry method heavy medium separator according to the present invention, respectively, where reference numbers in the accompanying drawings specifically refer to: 1: compressed air receiver, 2: floating material end medium drum screen, 3: dust collector pipeline, 4: material inlet, 5: main heavy medium separation machine, 6: magnetic separator, 7: bag-type dust collector, 8: media bucket elevator, 9: Roots blower, 10: induced draft fan of bag-type dust collector, 11: sediment end medium drum screen, and 12: high-pressure air pipe.

Because the products discharged by the dry method heavy medium separator carry a certain amount of media, a floating material end medium drum screen 2 and a sediment end medium drum screen 11 are arranged below the floating material discharge end and the sediment discharge end of the dry method heavy medium separator and are used for separating the separation products from media.

In order to prevent environment pollution caused by dust during the working process of the dry method heavy medium separator, the bag-type dust collector 7 is used for collecting dust, a dust connector pipeline 3 is arranged at the top of the dry method heavy medium separator, the air draft volume is larger than the air supply volume during working of the dry method heavy medium separator, the inside of the separator is in a negative pressure state, and therefore dust in the dry method heavy medium separator cannot escape; meanwhile, and suction pipes are arranged at the floating material end medium drum screen 2, the sediment end medium drum screen 11 and the magnetic separator 6, and the whole system is in a fully closed working state.

An air supply system of the dry method heavy medium separator consists of the compressed air receiver 1, the Roots blower 9 and the high-pressure air pipes 12 and provides a stable source during the working of the dry method heavy medium separator.

FIG. 2 is a process flow diagram of the dry method heavy medium separator according to the present invention. The dry method heavy medium separator is mainly used by the following steps:

Step 1, 6-100 mm-grade coal is fed into the dry method heavy medium separator and a dense medium is added into the dry method heavy medium separator too, where the fed materials of the dry method heavy medium separator are fed in uniformly along the width of the dry method heavy medium separator and the feeding amount and the addition of the dense media should be continuously adjustable;

Step 2, an airy supply system consists of a Roots blower, a compressed air receiver and a plurality of air pipes, the upper part of the dry method heavy medium separator is connected with an air draft dust collection system, and when the dry method heavy medium separator works, compressed air is provided for the inside of the dry method heavy medium separator by the air supply system and forms a gas-solid two-phase fluidized bed together with the dense media in a certain ratio, so as to further realize layering separation based on different densities;

Step 3, because products discharged by the dry method heavy medium separator carry a certain amount of media, medium drum screens are arranged and placed below the floating material discharge end and the sediment discharge end of the dry method heavy medium separator and used for separating the separation products from media; the separated media are elevated up into a magnetic separator at the upper part of the dry method heavy medium separator by a media bucket elevator, pulverized coal in the media is removed by the magnetic separator and then the pure media are unloaded inside the dry method heavy medium separator so that the media can be recycled so as to reduce medium consumption; and Step 4, a dust collection pipeline is arranged at the top of the dry method heavy medium separator and is connected with a bag-type dust collector, thereby reducing the environment pollution during the working of the dry method heavy medium separator.

FIG. 3 is a schematic diagram of the structure of a main heavy medium separation machine in the dry method heavy medium separator according to the present invention, where reference numbers in the accompanying drawings specifically refer to: 501: floating material end discharger, 502: floating material scraper chain wheel, 503: floating material scraper pressing wheel, 504: inspector window, 505: inspection door, 506: floating material chain scraper, 507: medium powder screw conveyor, 508: sediment scraper chain wheel. 509: sediment end discharger, 510: sediment scraper pressing wheel, 511: main separation machine landing leg, 512: sediment scraper, 513: high-pressure air chamber, 514: glass flowmeter and 515: main separation machine housing.

The floating material end discharger 501 and the sediment end discharger 509 are arranged at two sides of the main separation machine and used for discharging products and locking air. The whole main separation machine of the present invention is fully closed and use of the dischargers can ensure constant air pressure in the main separation machine without air leak.

As shown in FIG. 3, a separation system in the main separation machine consists of floating material scraper chain wheels 502, the floating material scraper pressing wheels 503, the floating material chain scraper 506, the sediment scraper chain wheels 508, the sediment end discharger 509, the sediment scraper pressing wheels 510 and the sediment scraper 512; separated floating material and sediment are respectively conveyed to discharge openings at two sides of the main separation machine and then discharged by the dischargers.

The glass flowmeter 514 is placed at the lower part of the dry method heavy medium separator and used for detecting the relative density of a gas-solid two-phase mixture in the dry method heavy medium separator, so as to help users to complete separation more visually and accurately.

The medium powder screw conveyor 507 is placed under a sediment scraper outlet and can be used for conveying the discharged media at the sediment end into the main separation machine. The inspector windows 504 and the inspection doors 505 are equipment inspection and overhaul windows and are formed in the main separation machine housing 515. The high-pressure air chambers can be used for more uniformly distributing high-pressure air blown out of the Roots blower in the main separation machine.

Figures 1, 4:
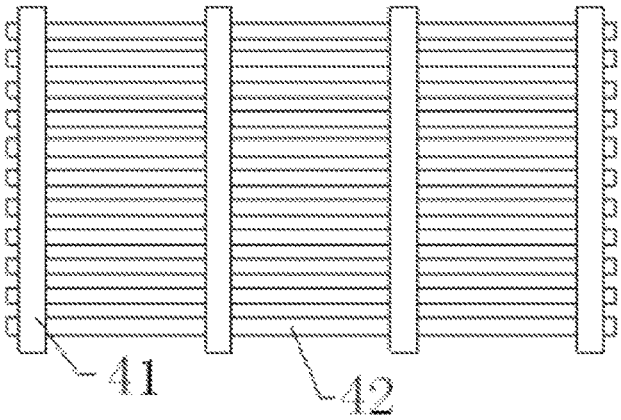
Figures 2, 4:
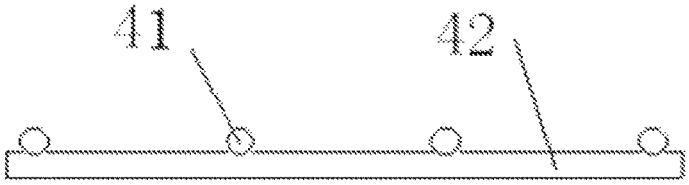
Figures 3, 4:
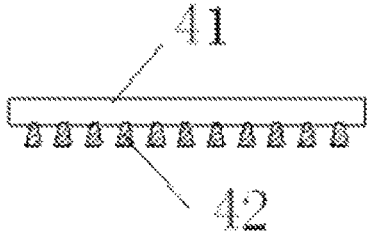

FIG. 4-1 is a schematic diagram of a stainless steel grate in a dry method heavy medium separation mechanism, where FIG. 4-2 is a schematic diagram of its longitudinal section and FIG. 4-3 is a schematic diagram of its cross section. The stainless steel grate consists of round pull rods 41 and grate bars 42.

The stainless steel grates are distributed in the high-pressure air chambers and used for preventing large-grained materials from entering the air chambers under the grates. The stainless steel grates are selected because of good wear resistance, corrosion resistance, good rigidity and stable performance.

Figures 1, 5:
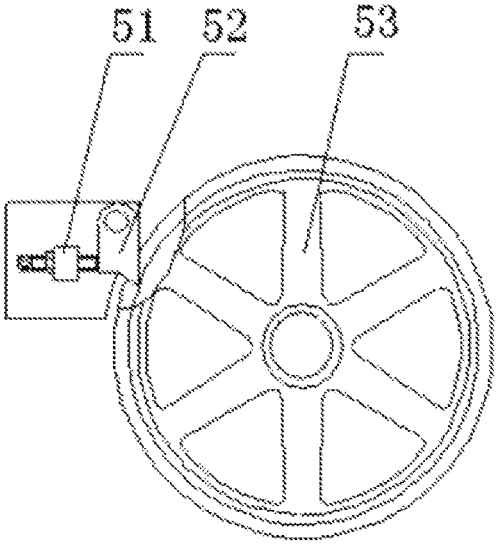
Figures 2, 5:
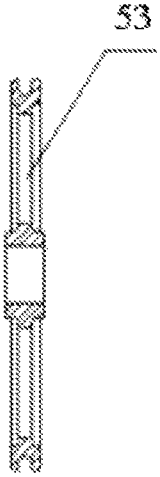

FIG. 5-1 is a front view of a scraper pressing wheel cleaning mechanism and FIG. 5-2 is a left view of a scraper pressing wheel, where reference number particularly refer to: 51—adjustable bolt, 52—comb tooth and 53—pressing wheel. The comb tooth 52 is a pointed steel plate capable of rotating according to a certain track; supported by the adjustable bolt 51, there is a 2 mm clearance in the diameter direction of the excircle of a groove of the pressing wheel, and the pointed tooth works normally to scrape materials attached to the pressing wheel away, thereby preventing changing the operation track of the scraper conveyor.

Figures 1, 6:
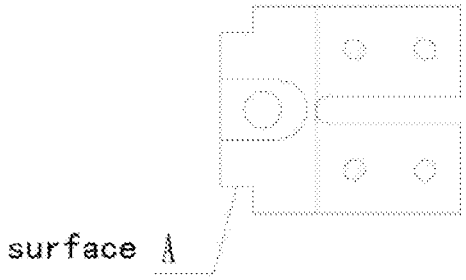
Figures 2, 6:
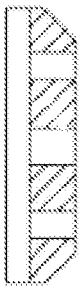

FIG. 6-1 is a front view of a wearable block of a scraper conveyor and FIG. 6-2 is a sectional view of the wearable block of the scraper conveyor. The wearable block is a special part of the scraper conveyor in the main separation machine and functions as a transitional link connecting scrapers and chains. During working, the wearable block slides along a rail in the main separation machine, so it is required to carry out were-resistant treatment on the wearable block (for example the surface A as shown in the figure) and the wear hardness should reach HRC55 or above.

Figures 1, 7:
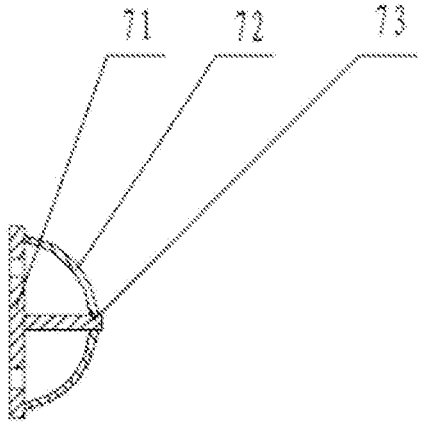
Figures 2, 7:
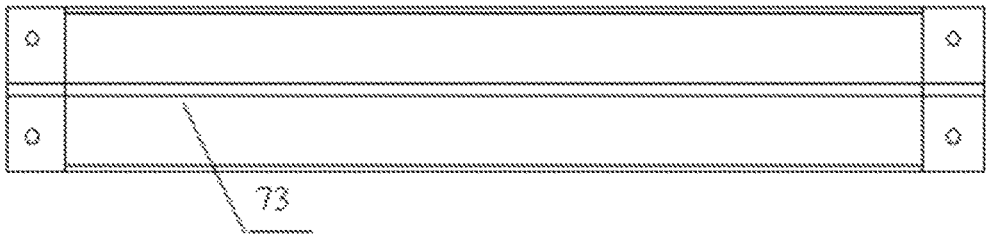

FIG. 7-1 is a right view of a scraper and FIG. 7-2 is a front view of the scraper, where reference numbers in the accompany drawings particularly refer to: 71: scraper bottom plate, 72: reinforcing arc plate and 73: vertical rib. When the separation bed surface of the main separation machine exceeds a specific value, in order to enhance its rigidity and bending resistance and prevent overweight, the scraper can be made according to the structure as shown in the figures, thereby saving materials and not affecting its rigidity.

Figures 1, 8:
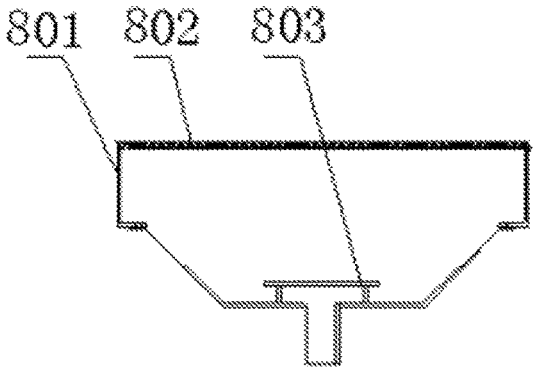
Figures 2, 8:
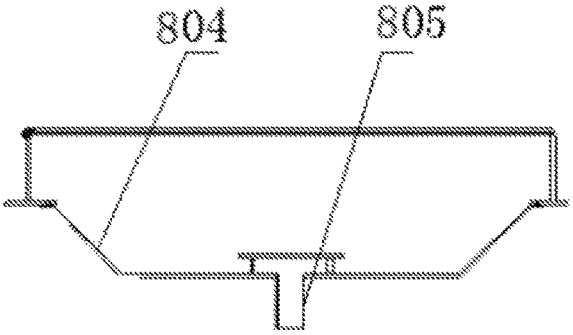

FIG. 8-1 is a schematic diagram of details of a high-pressure air chamber and FIG. 8-2 is a schematic diagram of details of another high-pressure air chamber, where reference numbers in the accompanying drawings particularly refer to: 801: air chamber side plate, 802: stainless steel grate, 803: air distributor, 804: air chamber base plate and 805: air inlet pipe. The air chamber consists of the air chamber side plates 801 and the air chamber bottom plate 804, the air distributor 803 is above the bottom plate, the air inlet pipe is provided with a hole in the bottom plate, and the stainless steel grate 802 is arranged above the air chamber. The air chambers are used for supplying air more uniformly without dead angle.

The dry method heavy medium separator according to the present invention solves such problems of an existing single-chain scraper conveyor as single speed, low coal conveying efficiency at the upper end, poor gangue scraping effect at the lower end, the existence of dead angles, etc.

With adoption of the dry method heavy medium separator according to the invention, a dry method heavy medium separator adopting a dry method heavy medium fluidized bed can be provided. The dry method heavy medium separator has a fluidization separation bed which can overcome defects existing in the prior art and also has reasonable discharge scrapers, reasonable adjustable discharge speed, reasonable effective separation section length and separation bed height. Further, the dry method heavy medium separator is equipped with reasonable medium separation devices for improving the medium separation effect and increasing the recycling rate of products.

More further, with adoption of the dry method heavy medium separator, a separation device adopting a dry method heavy medium fluidized bed can be provided, which can integrate separation and dust collection, air supply and material feeding into a whole; its separation groove solves defects of a separation groove in the prior art.

Essentially, for overcoming the defects in the prior art, the dry method heavy medium separator according to the present invention first provides a heavy medium fluidized bed, including: three flowing material flows (air, a dense medium and coal) used in the separation bed meet in the separation bed; the dense media are in a fluidization separation chamber; and compressed air enters air chambers for primary pressure equalizing and then enters the fluidization separation chamber to fluidize the dense media so as to form a fluidized bed suitable for separation. A double-chain scraper conveyor rotates counterclockwise respectively at different speeds; separation coal enters from one end at the upper part of a bed body; the fed materials are pushed by an upper chain to move leftwards and are layered during the movement, sediment will not be pushed by a scraper anymore and will gradually go down to the bottom of the fluidization separation chamber, and a lower chain discharges the sediment from a tailing end; floating material above the fluidized bed is discharged by the upper chain from a clean coal end. Fluidization is a continuous air draft process; after gas rises up from a solid particle interface, it should be in a positive state, but the upper space in the main separation machine is in a negative pressure state and dust at the coal discharge ends and other positions will not escape since the air draft volume for dust collection is larger than the air volume for fluidization. The floating material and the sediment, when discharged, will carry part of the dense media, and after medium separation with drum screens, oversize products can be conveyed to a specified position by a conveying device; the undersize dense media fall down to a lower medium bed and then are loaded to the bucket elevator and returns to the main separation machine via a chute.

The function of drum screen medium separation devices is that clean coal and gangue obtained after separation by the separation bed are respectively discharged from a clean coal outlet and a gangue outlet and then enter respective drum screen medium separation devices for separating media, and the drum screens drive screen surfaces to rotate through the rotation of central shafts so that the materials are subjected to medium separation on the rotating screen surfaces. With adoption of such devices, relatively high medium separation efficiency is achieved.

In order to effectively separate materials in the fluidized bed, separated light-density material adequately floats up while heavy-density material goes down completely; moreover, with adoption of a double-chain chain plate discharge device, an upper-layer chain plate can be used for conveying the light-density material so that the two materials can be separated adequately.

One of the inventive points of the present invention lies in that based on the design optimization and innovation of the key parts and overall structure of a dry method heavy medium separator, the researched dry method heavy medium separator adopting a dry method heavy medium fluidized bed is significantly improved in the uniformity and stability of the fluidized bed and the separation effect, has reduction in maintenance load and time of equipment and the long-time, continuous, stable and efficient operation of the dry method heavy medium separator can be ensured.

Another inventive point of the present invention lies in a novel as distributor and an easily detached air distribution device. The gas distributor is a key factor influencing bed fluidization and separation performance and its main parameters include material, structure, pressure drop, porosity, pore diameter and the like. In order to continuously discharge separation products out of the separator, a scraper conveyor is arranged in the fluidized bed; under the thrust action of an air distributor, high-density and high-hardness sediment presses and rubs against the air distributor and therefore is broken at different levels to generate fine sediment; meanwhile, the upper surface of the air distributor is subject to different levels of wear. Therefore, the air distributor should have excellent anti-clogging holes, be easy to clean and can resist against wear. Based on a special process requirement and a pressure drop number Cp discriminance, a great deal of theoretical and experiment researches are performed to develop two types of compound type gas distributor: one is a steel-based fiber compound distributor mainly made by compounding and pressing a steel-based fiber plate and a fiber layer together and featured with flat surface, wear resistance and massive material embedding resistance, uniform air distribution and the like, where the steel-based material plate is used for supporting bed materials and resisting against impact and wear and the fiber layer is used for controlling pressure drop and distributing air uniformly; and the other one is a two-section compound type high pressure drop gas distributor, mainly made by overlapping a steel-based porous guard plate and a wire mesh pressboard or woven cloth and featured with easy cleaning, flat surface, wear resistance and the like, where the steel-based porous guard plate is used for supporting bed materials and resisting against impact and wear and can be detached for cleaning if necessary, and moreover, in order to effectively increase a clogging cycle, tapered pores may be adopted and a proper height-diameter ratio should be selected as well; the wire mesh pressboard or woven cloth is used for controlling pressure drop and uniformly distribute air and also capable of resisting against massive material embedding and assisting in supporting bed materials.

In the separation process of coal, the scraper conveyor of the dry method heavy medium separator needs to discharge separated products out of the separator continuously; under the thrust action of the scraper conveyor, high-hardness sediment accumulated at the bottom of the bed presses and rubs against the air distributor all the time, that causes the break of the sediment and the wear of the upper surface of the air distributor and the smashed fine particles are likely to block the gas inlet, which will affect the performance and service life of the air distributor. The air distributor is hard to change once it is damaged and its change workload is heavy and takes 5-7 days. In order to solve this problem, a drawer type detachable air distribution device is provided and it takes only 3-5 hours to disassemble and assemble and therefore the air distribution device is easy to repair and adjust, thereby ensuring long-time, continuous and stable operation of the dry method heavy medium separator without affecting the production task.

Dense Medium Short-Distance Return Device:

In a separation process, a part of dense media is discharged out of the dry method heavy medium separator; if the circulating amount of the dense media is large, the control difficulty of the fluidized bed will be increased and the separation effect will be affected. In order to reducing the circulating amount of the dense media, a dense medium short-distance return device is added in the design process of the dry method heavy medium separator, as shown in FIGS. 5-1 and 5-2 and FIGS. 6-1 and 6-2. With adoption of the short-distance return device, the external dense medium circulating amount is reduced by 80%, the operation power consumption and cost are reduced largely, the control of the fluidized bed becomes easy and the separation effect is improved.

A further inventive point of the present invention lies in the optimization of design of the process system.

A modular dry method heavy medium fluidized bed coal separation system is a continuous-operating efficient dry method coal separation system implemented through assembling raw coal preparation, separation, medium purification and recycling, air supply and dust collection on the same platform. The separation system works based on the following principles:

(1) Fluidization Separation Process

Fine solid dense media form a gas-solid two-phase flow with fluid-like characteristics under the action of an upflow after uniform air distribution; under the uplift action of global density of the fluidized bed in a gas-solid tow-phase flow bed, separation materials are layered according to the bed density; material with density lower than the bed floats up while material with density higher than the bed density goes down; and layered light and heavy products are respectively discharged through a scraper conveyor, thereby finishing the separation process. The dry method heavy medium separator adopting the dry method heavy medium separation bed works to separate the separation materials using the above-mentioned principle so as to obtain clean coal and tailing products.

(2) Working Process of Separation System

The process flow of the system is that compressed air forms a uniformly distributed upflow through a preliminary air distribution chamber and an air distributor and acts on the dense media in the dry method heavy medium separator to form a fluidized bed with a certain density; separation raw coal, after being (dried) graded (100-6 mm), is uniformity fed in the dry method heavy medium separator through a feeder; light and heavy products layered according to the density of the fluidized bed are discharged through dischargers the light and heavy products are respectively subjected to medium separation through medium separation screens to obtain clean coal and tailing; a part of the dense media separated by the medium separation screens enters the magnetic separator for removing nonmagnetics (pulverized coal) therein and the other part is recycled for use; and circulating medium shunt volume, the feeding amounts of magnetic concentrate and circulating media are adjusted according to the height and density of the fluidized bed in the dry method heavy medium separator, thereby realizing the control over the height and density of the fluidized bed. Dust generated during the working of the separation system is collected and circulated by an air draft dust collector.

(3) Breakthroughs of the Dry Method Heavy Medium Separator

Through breaking through the traditional wet method coal separation theory, a concentrated phase high density gas-solid fluidization dry separation theory is created and an air distribution and wide-size dense medium grading principle is put forward. The two-section compound type high pressure drop gas distributor, featured with uniform air distribution, easy disassembly and resistance against clogging and wear, is developed; the short-distance return device is designed to reduce the circulating amount of dense media by 80%; and due to adoption of wide-size dense media, the dominant size range is widened 2.5 times and therefore the operating cost is reduced largely.

A new generation of dry method heavy medium separator adopting a dry method heavy medium fluidized bed and its relevant supporting devices are integrated, modularized, so as to research a modular dry method heavy medium fluidized bed coal separation system and device with processing capability of 40~60 t/h, separating accuracy (probable deviation E value) of 0.05-0.08 g/cm3, fed material size of 100-6 mm, adjustable separation density range of 1.3-2.2 g/cm3, separation quantitative efficiency being higher than 90%, and medium consumption per ton of coal being less than 0.5 kg. The air draft volume of the modular dry method heavy medium fluidized bed coal separation system is larger than the air supply volume, the system is in a negative pressure state, and the dust collection system is matched reasonably to ensure low dust; and the system operates steadily with low noise, which meets the requirement for environment protection.

As stated above, the technical solution provided by the present invention has been clearly described. Even if the preferred embodiments of the present invention has described and explained the present invention in detail, it still should be understood by those skilled in the art that numerous modifications in form and details can be made without departing from the scope and spirit of the present invention, defined by appended claims.

We claim:

1. A separation method comprising the following steps:

feeding 6-100 mm-grade coal into a dry method heavy medium separator and adding dense media into the dry method heavy medium separator, wherein the 6-100 mm-grade coal is uniformly fed into the dry method heavy medium separator along the width of the dry method heavy medium separator, and wherein the amount of dense media added to the dry method heavy separator is continuously adjustable, wherein the dry method heavy medium separator comprises:

a compressed air receiver, a floating material end medium drum screen, a dust collector pipeline, a material inlet, a main heavy medium separation machine, a magnetic separator, a bag-type dust collector, a medium bucket elevator, a Roots blower, a bag-type dust collector induced draft fan, a sediment discharge end medium drum screen, and high-pressure air pipes, wherein the floating material end medium drum screen and the sediment discharge end medium drum screen are arranged below a floating material discharge end and a sediment discharge end of the dry method heavy medium separator, wherein the floating material end medium drum screen and the sediment discharge end medium drum screen are used for separating separation products from media, wherein the bag-type dust collector is used for collecting dust, wherein the dust collector pipeline is arranged at a top of the dry method heavy medium separator, wherein an air draft volume is larger than an air supply volume during working of the dry method heavy medium separator so that the inside of the dry method heavy medium separator is in a negative pressure state such that dust in the dry method heavy medium separator cannot escape, wherein suction pipes are arranged at the floating material end medium drum screen, the sediment discharge end medium drum screen, and the magnetic separator, and wherein the dry method heavy medium separator is in a fully closed working state;

providing compressed air to the inside of the dry method heavy medium separator with an air supply system, and forming a gas-solid two-phase fluidized bed with the dense media so as to realize layering separation based on different densities, wherein the air supply system comprises the Roots blower, the compressed air receiver, and the high-pressure air pipes, wherein an upper part of the dry method heavy medium separator is connected to an air draft dust collection system;

arranging, because products discharged by the dry method heavy medium separator carry a certain amount of media, the floating material end medium drum screen and the sediment discharge end medium drum screen below a floating material discharge end and a sediment discharge end of the dry method heavy medium separator, using the floating material end medium drum screen and the sediment discharge end medium drum screen to separate the separation products from media, elevating the separated media into the magnetic separator at the upper part of the dry method heavy medium separator with the medium bucket elevator, removing pulverized coal in the media with the magnetic separator, and unloading pure media inside the dry method heavy medium separator so that the media can be recycled so as to reduce medium consumption; and arranging a dust collection pipeline at the top of the dry method heavy medium separator and connecting the dust collection pipeline to the bag-type dust collector to reduce environmental pollution during the working of the dry method heavy medium separator.

2. The separation method according to claim 1, wherein the dry method heavy medium separator comprises an air supply system, wherein the air supply system comprises the compressed air receiver, the Roots blower, and the high-pressure air pipes, and wherein the air supply system provides a stable source of air during the working of the dry method heavy medium separator.

3. The separation method according to claim 1, wherein the dense media is magnetite powder.

4. The separation method according to claim 1, wherein the dry method heavy medium separator further comprises a double-chain scraper conveyor, wherein the double-chain scraper rotates counterclockwise respectively at different speeds, wherein separation coal enters the double-chain scraper from one end at an upper part of a bed body, wherein fed materials are pushed by an upper chain to move in a first direction and are layered during the movement, wherein a portion of sediment is not pushed by a scraper and goes down to the bottom of the fluidization separation chamber, wherein a lower chain discharges sediment from a tailing end, wherein floating material above the fluidized bed is discharged by the upper chain from a clean coal end, wherein an upper space inside the main heavy medium separation machine is in a negative pressure state, wherein after medium separation with the drum screens, oversize products can be conveyed to a specified position by a conveying device, wherein undersized dense media fall down to a lower medium bed and then are loaded to the medium bucket elevator and returned to the main heavy medium separation machine via a chute, wherein clean coal and gangue obtained after separation by the dry method heavy medium separation bed are respectively discharged from a clean coal outlet and a gangue outlet and then enter respective drum screen medium separation devices for separating media, and wherein the drum screens comprise drive screen surfaces that rotate about central shafts so that materials are subjected to medium separation on the rotating screen surfaces.

5. The separation method according to claim 1, wherein a floating material end discharge device and a sediment end discharge device are arranged on two sides of the main heavy medium separation machine and used for discharging the products and locking air.

6. The separation method according to claim 1, wherein in a pre-fluidization configuration, compressed air enters air chambers for primary pressure equalizing and then in a fluidization configuration, the compressed air from the air chambers enters the fluidization separation chamber to fluidize dense media and coal, wherein the amount of dense media added to the dry method heavy separator is continuously adjustable, so as to form a fluidized bed suitable for separation.

* * * * *